United States Patent [19]

Ashley

[11] 4,205,604

[45] Jun. 3, 1980

[54] SCRAP SHEAR MACHINE WITH ADJUSTABLE THROAT

[75] Inventor: P. Gene Ashley, Waco, Tex.

[73] Assignee: Mosley Machinery Company, Inc., Waco, Tex.

[21] Appl. No.: 24,982

[22] Filed: Mar. 29, 1979

[51] Int. Cl.[2] ..... B30B 15/30; B30B 15/04

[52] U.S. Cl. ..... 100/95; 83/437; 83/449; 100/215; 100/232; 100/242; 100/295

[58] Field of Search ..... 83/278, 437, 446, 449; 100/232, 215, 295, 233, 95, 242, 39, 42, 246

[56] References Cited

U.S. PATENT DOCUMENTS

| | | | |
|---|---|---|---|
| 1,550,045 | 8/1925 | Power | 100/95 |
| 2,748,694 | 6/1956 | Thompson | 100/232 |
| 2,794,386 | 6/1957 | Beecher | 100/218 |
| 2,865,284 | 12/1958 | Thompson | 100/232 |
| 2,923,231 | 2/1960 | Jones | 100/232 |
| 2,932,247 | 4/1960 | Thompson | 100/232 |
| 3,049,988 | 8/1962 | Lindemann | 100/95 |
| 3,124,062 | 3/1964 | Thompson | 100/215 |
| 3,283,697 | 11/1966 | Findlay | 100/95 |
| 3,563,163 | 2/1971 | Schoenauer | 100/95 |
| 3,782,274 | 1/1974 | Thompson | 100/95 |
| 3,945,315 | 3/1976 | Dahlem | 100/95 |
| 4,062,281 | 12/1977 | Tripp | 100/95 |

FOREIGN PATENT DOCUMENTS

| | | | |
|---|---|---|---|
| 804894 | 3/1951 | Fed. Rep. of Germany | 100/95 |

*Primary Examiner*—Billy J. Wilhite

*Attorney, Agent, or Firm*—Brumbaugh, Graves, Donohue & Raymond

[57] ABSTRACT

A scrap shear machine comprises a compression box for compressing scrap into a scrap log, a shear formed with a throat mounted adjacent to the compression box, and an indexing ram and a ram head mounted thereon for incrementally advancing the log into the throat of the shear, whereby increments of the log are sheared off. Means are provided for adjusting the width of the compression box and shear throat and for adjusting the width of the ram head in accordance with the width of the compression box and shear throat, whereby the maximum dimension of the sheared scrap can be controllably adjusted in one pass through the machine.

7 Claims, 7 Drawing Figures

SCRAP SHEAR MACHINE WITH ADJUSTABLE THROAT

BACKGROUND OF THE INVENTION

This invention relates to scrap shear machines and, more particularly, to a novel and highly-effective scrap shear machine wherein the maximum dimension of the scrap processed by the machine can be controllably adjusted in one pass through the machine.

Scrap metal is divided into ferrous and nonferrous categories and within each category is sold by dimension. For example, scrap having a maximum dimension of three feet, four feet, or five feet is sold by the scrap processor, depending on the requirements of the smelter or other customer for the scrap metal. If the customer will accept scrap having a maximum dimension of five feet (five-foot scrap), the scrap processor will wish to sell five-foot scrap rather than smaller scrap, because it requires additional cutting and handling and hence more expense to produce the smaller scrap. On the other hand, if the customer requires three-foot scrap, the scrap metal processor must be in a position to supply three-foot scrap, since larger scrap will be unacceptable.

At present, commercial practice is either to have several scrap shear machines for producing scrap of different sizes or to have, for example, a machine for producing five-foot scrap and to run the scrap through a second time in a different orientation in order to produce smaller scrap when necessary. The additional capital investment, handling, and work crews, as may be required, add considerably to the cost of processing the scrap metal.

SUMMARY OF THE INVENTION

An object of the invention is the remedy the problems outlined above and, in particular, to provide a scrap shear machine wherein the maximum dimension of the scrap processed by the machine can be controllably adjusted in one pass through the machine.

The foregoing and other objects are attained in a scrap shear machine comprising a compression box for compressing scrap into a scrap log, a shear formed with a throat mounted adjacent to the compression box, and an indexing ram and a ram head mounted thereon for incrementally advancing the log into the throat of the shear, whereby increments of the log are sheared off. In accordance with the invention, means are provided for adjusting the width of the compression box and shear throat and for adjusting the width of the ram head in accordance with the width of the compression box and shear throat, whereby the maximum dimension of the sheared scrap can be controllably adjusted in one pass through the machine.

The invention in its preferred embodiments comprises a number of additional features that contribute to its efficient operation. Thus the machine preferably further comprises means such as a piston-cylinder mechanism for adjusting the lateral position of the indexing ram in accordance with the adjustment made in the width of the ram head, whereby the ram head remains centered with respect to the indexing ram despite adjustments to the width of the ram head.

A side wall of the compression box is preferably movable, and the means for adjusting the width of the compression box and shear throat comprises piston-cylinder means connected to the movable side wall for adjusting the lateral position thereof.

The means for adjusting the width of the ram head comprises a set of ram heads of different widths and means for securing a selected one of the set to the ram. The ram head is of generally rectangular cross section, and the securing means comprises bolts passed through apertures formed in the ram head adjacent to the four corners of the rectangular cross section.

Precompression piston-cylinder means is preferably mounted adjacent to the shear box for precompressing the scrap log as it enters the shear throat.

BRIEF DESCRIPTION OF THE DRAWING

A better understanding of the invention may be gained from a consideration of the following detailed description of the preferred embodiments thereof, taken in conjunction with the appended figures of the drawing, wherein.

DESCRIPTION OF THE PREFERRED EMBODIMENTS

Figure 1:
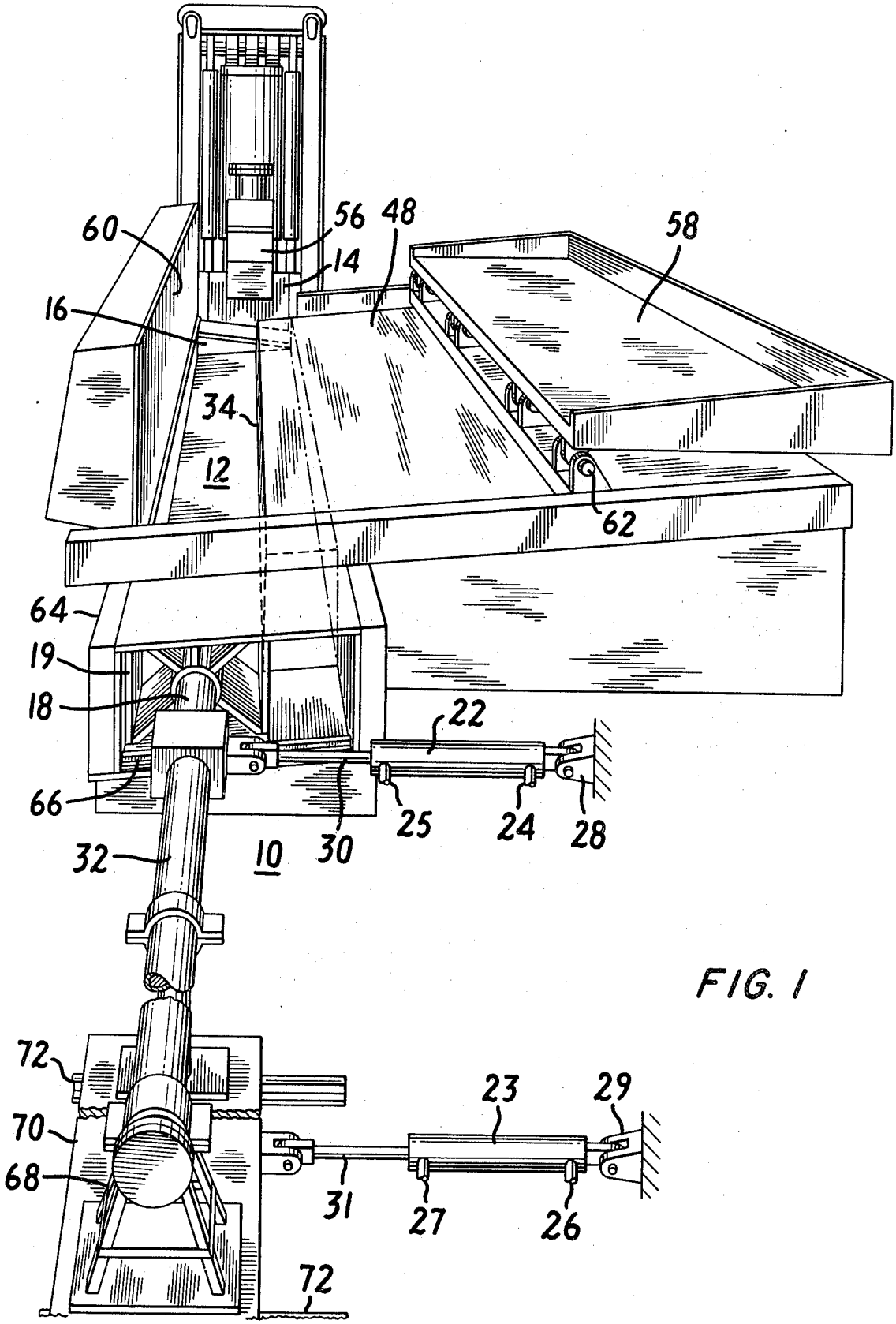
FIG. 1 is a perspective view of a preferred embodiment of apparatus constructed in accordance with the invention.
Figure 6:
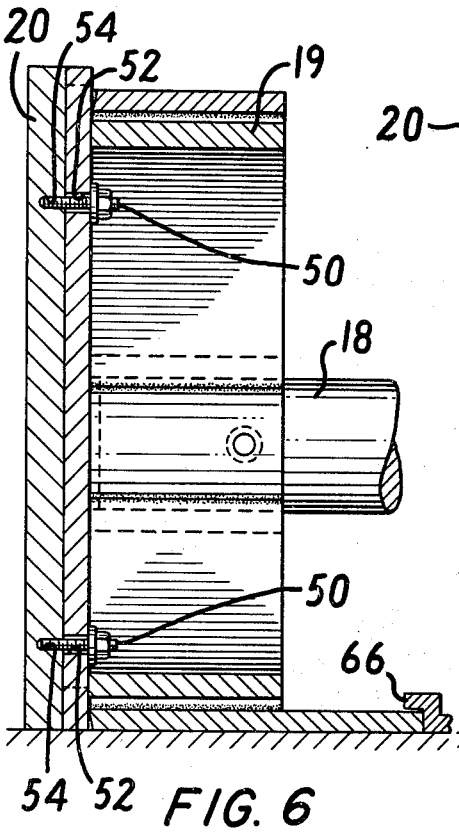
FIG. 6 is a sectional view taken along the line 6—6 of FIG. 5 and looking in the direction of the arrows.

FIG. 1 shows a scrap shear machine 10 constructed in accordance with the invention. It comprises a compression box 12 for compressing scrap (not shown) into a scrap log of rectangular cross section, a shear 14 formed with a throat 16 mounted adjacent to the compression box 12, and an indexing ram 18 and, mounted on the end 19 thereof, a ram head or face plate 20 (see FIG. 6, for example). The indexing ram 18 with its ram head 20 incrementally advances the scrap log into the throat 16 of the shear 14. The shear 14 is conventional and intermittently shears off portions of the scrap log.

In accordance with the invention, means is provided as described in detail below for adjusting the width of the compression box 12 and shear throat 16, and means is further provided for adjusting the width of the ram head 20 in accordance with the width of the compression box 12 and shear throat 16. The maximum dimension of the sheared scrap can thus be controllably adjusted in one pass through the machine. The machine 10 preferably further comprises means for adjusting the lateral position of the indexing ram 18 in accordance with the adjustment made in the width of the shear throat 16, compression box 12 and ram head 20, whereby the ram head 20 remains centered with respect to the indexing ram 18 despite adjustments of the width of the ram head 20.

The means for adjusting the lateral position of the indexing ram 18 comprises piston-cylinder means 22, 23

(FIGS. 1, 3 and 4) directly or indirectly connected thereto in any suitable manner. Hydraulic lines 24, 25, 26 and 27 are respectively connected to opposite ends of the cylinders to control the movements of the pistons (not shown) mounted within the piston-cylinder means 22, 23. The hydraulic lines 24 through 27 are connected to a single hydraulic control and the cylinders are anchored as indicated at 28 and 29, respectively, so that rams 30, 31 are extended or retracted together and by equal amounts. The ends of the rams opposite the piston-cylinder assemblies 22, 23 are connected directly or indirectly to spaced-apart points of a cylinder 32. The cylinder 32 houses the indexing ram 18, and means (not shown) is provided for introducing a hydraulic fluid into the cylinder 32 near opposite ends thereof in order to control the movement of the piston (not shown) mounted within the cylinder 32 and hence to control the movement of the ram 18 and ram head 20, whereby the ram head 20 can be retracted to allow scrap to be dumped into the box 12 for compression into the form of a scrap log and can be extended to force successive increments of the scrap log into the throat 16 of the shear 14.

Figure 2:
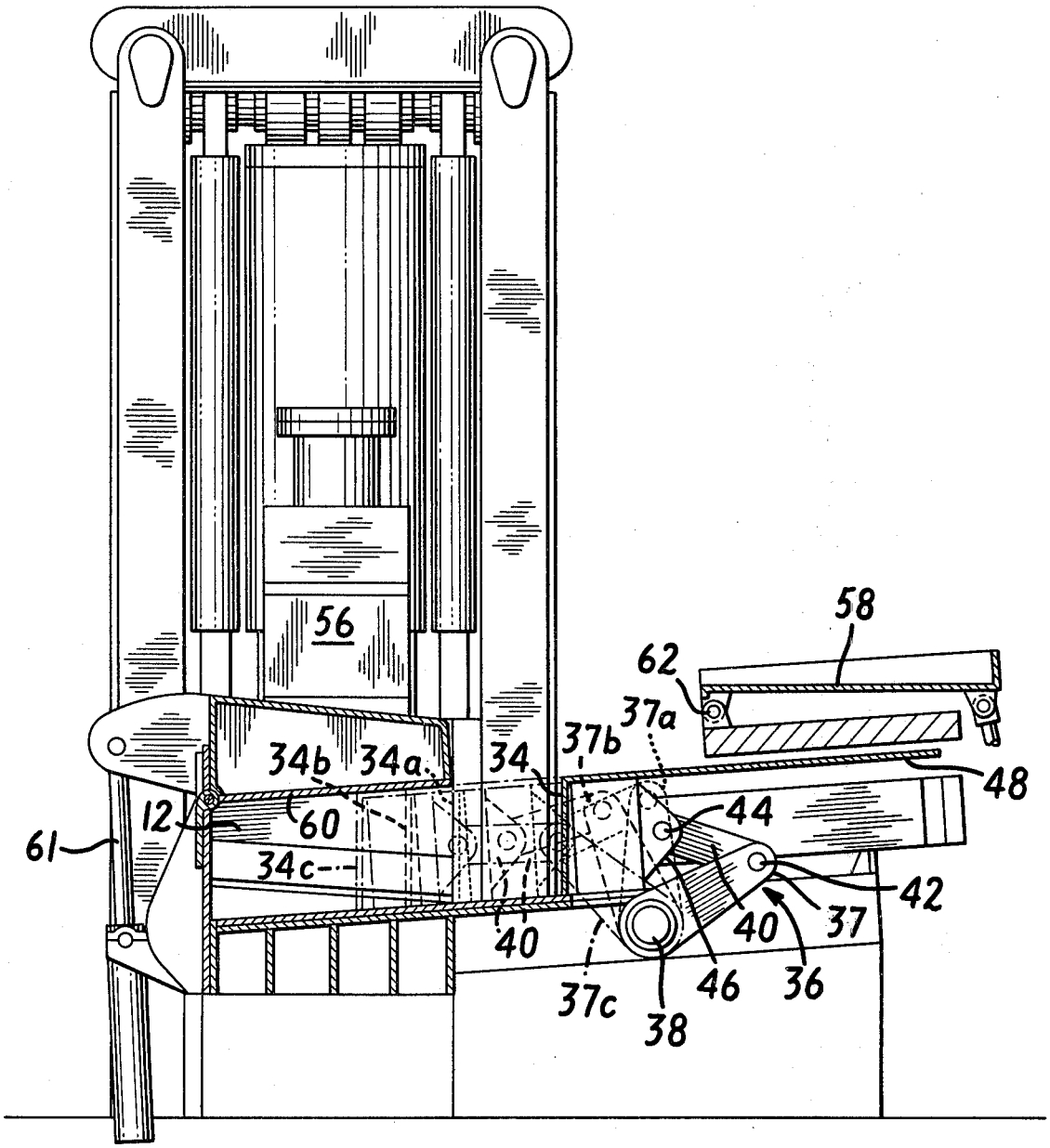
FIG. 2 is a sectional and end elevational view of the apparatus of FIG. 1.

In accordance with the invention, a side wall 34 of the compression box 12 is movable, and the means for adjusting the width of the compression box 12 and shear throat 16 comprises compression means 36 (FIG. 2) connected thereto. The compression means 36 may be powered in any conventional manner, for example, by piston-cylinder means (not shown). FIG. 2 shows the compression means 36 with its crank arm 37 in a fully retracted position (solid outline) and in three different extended positions identified as 37*a*, 37*b*, and 37*c*, respectively. The crank arm 37 is pivotally mounted at one end thereof about a pivot 38 and is connected at the opposite end thereof to one end of a link 40 by a pin 42. The other end of the link 40 is connected by a pin 44 to flange means 46 integral with a plate 48 having a portion that extends generally horizontally and, at the left thereof as seen in FIG. 2, a vertical portion constituting the movable side wall 34 of the compression box 12.

Upon movement of the compression means 36 as indicated above, the side wall 34 advances to the left as seen in FIG. 2 from the retracted position shown in solid outline to a selected one of a number of extended positions indicated, respectively, as positions 34*a*, 34*b* and 34*c*.

Position 34*a* may correspond to scrap having a maximum dimension of 5 feet, position 34*b* to scrap having a maximum dimension of 4 feet, and position 34*c* to scrap having a maximum dimension of 3 feet. The position of the side wall 34 determines the lateral dimension of the compression box 12 and hence of the width of the throat 16 of the shear 14.

Figure 7:
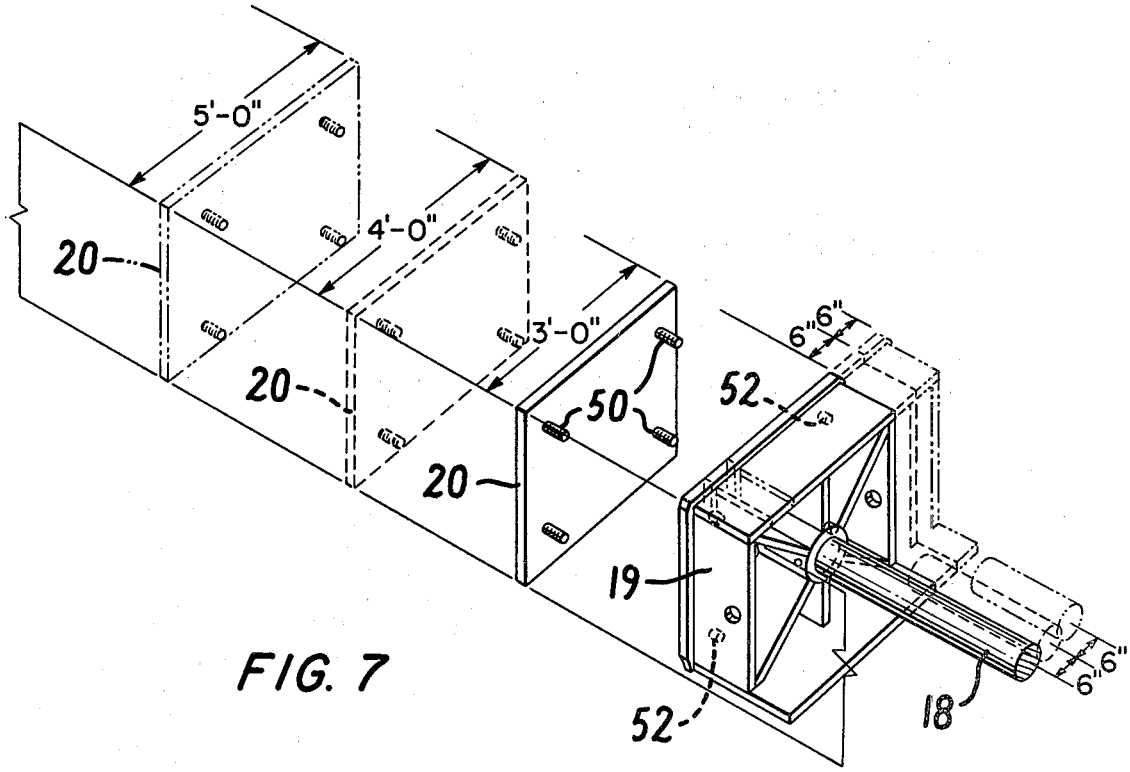
FIG. 7 is a perspective view illustrating a set of ram heads of different widths in accordance with the invention.

In accordance with the invention the width of the ram head 20 is adjusted in accordance with the width of the compression box 12 and shear throat 16. To this end, a set of ram heads 20 is provided (FIG. 7), the different ram heads being of different widths, such as 5 feet, and 4 feet, and 3 feet, and means is provided for securing a selected one of the set to the end 19 of the indexing ram 18.

Figure 5:
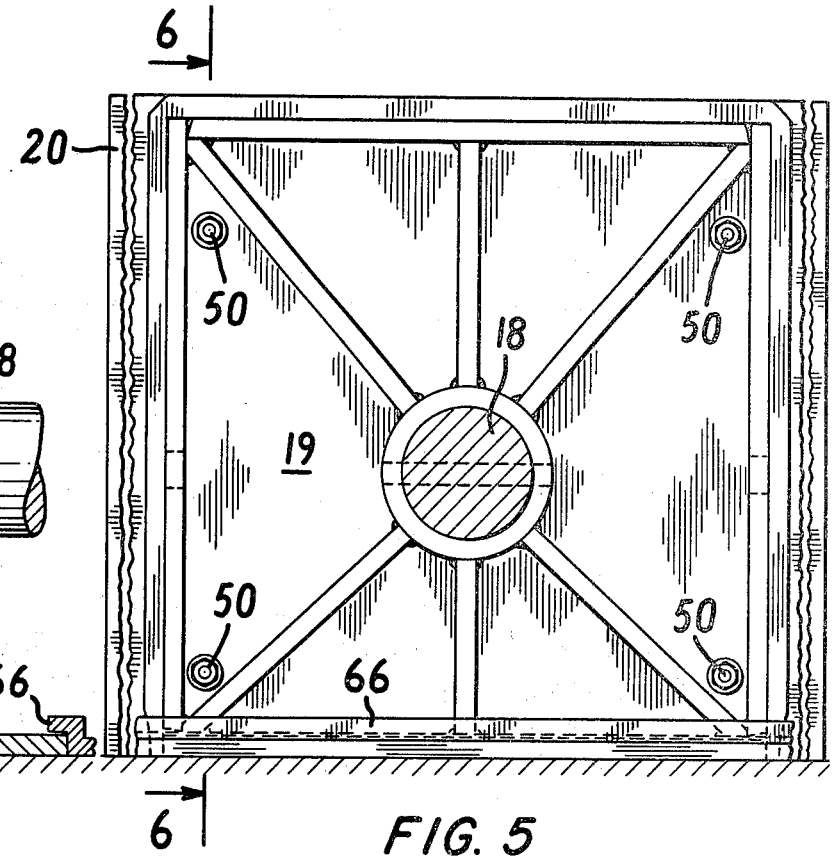
FIG. 5 is an end elevational view of a ram head affixed to one end of the ram employed in the apparatus of the invention.

The indexing ram heads are of generally rectangular cross section, as FIG. 5 shows, and the securing means comprises bolts 50 (FIGS. 5 and 6) passed through bolt holes or apertures 52 on the end 19 of the ram 18 and into blind-tapped holes or apertures 54 on the ram head 20. The bolt holes 52, 54 are adjacent to the four corners of the rectangular cross section of the ram head 20.

Precompression piston-cylinder means 56 (FIGS. 1–3) is preferably mounted adjacent to the shear 14 for precompressing the scrap log at a point just prior to the introduction of the log into the throat 16 of the shear 14.

Figure 3:
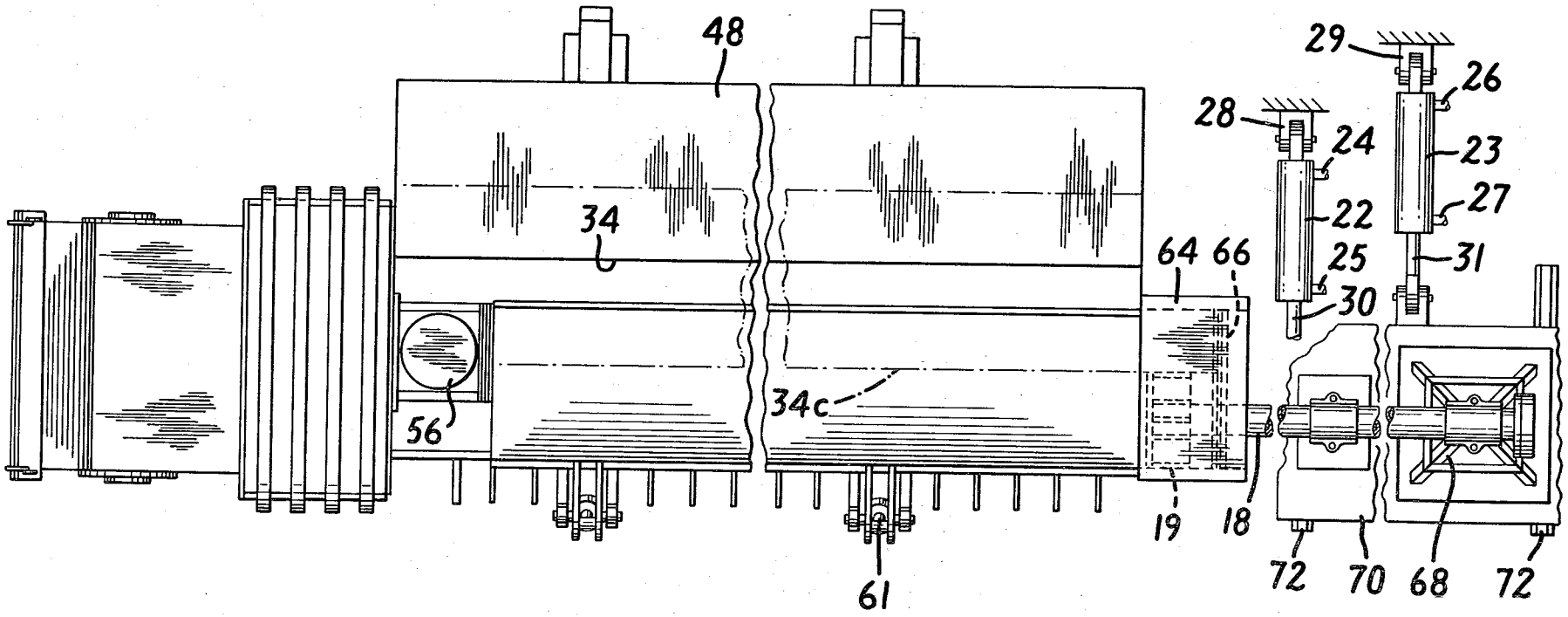
FIG. 3 is a top plan view of the apparatus of FIGS. 1 and 2.
Figure 4:
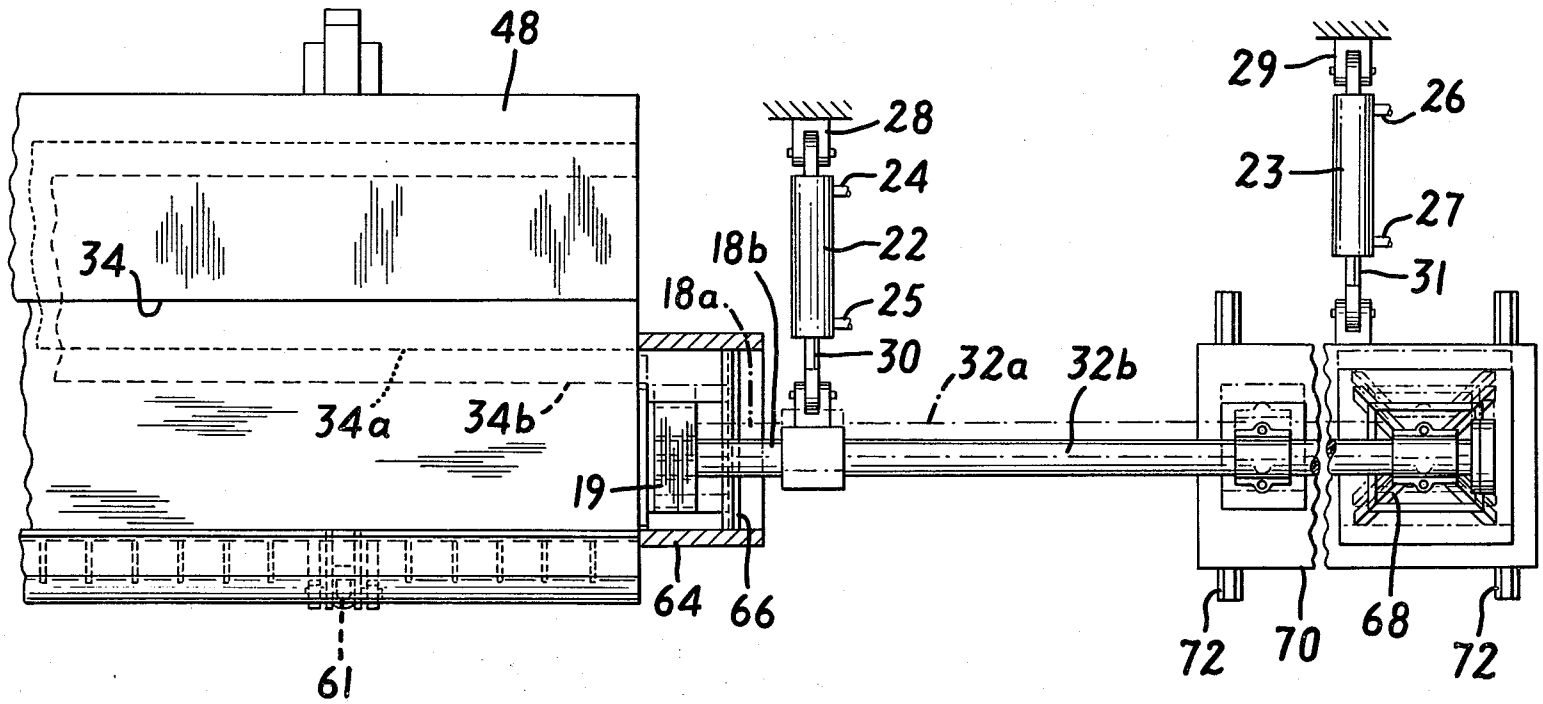
FIG. 4 is a view similar to FIG. 3 illustrating lateral movement of a portion of the apparatus in accordance with the invention.

In operation, a crane (not shown) dumps scrap to be processed onto a loading tray 58 (FIGS. 1 and 2). The plate 48 with its wall 34 defining one side of the compression box 12 is withdrawn to the right as seen in FIGS. 1 and 2 (towards the top of the figures as seen in the plan views of FIGS. 3 and 4) to its fully-retracted position. A lid 60 is in the open position as shown in FIG. 1. The tray 58 then moves counterclockwise about pivot means 62, under the control of a hydraulic actuator (not shown), and dumps the load of scrap into the compression box 12. The lid 60 is moved clockwise under the control of a hydraulic actuator 61 (FIG. 2), and the tray 58 is withdrawn to the position shown in FIG. 1. Then lid 60 and side wall 34 are jockeyed back and forth in order to compress the scrap. The compression means 36 is actuated in order to move the wall 34 to the left as seen in FIGS. 1 and 2 (towards the bottom of the figures as seen in FIGS. 3 and 4). By this means, the scrap in the compression box 12 is compressed into a scrap log having a generally rectangular cross section. The width of this log, i.e. its dimension extending left and right in FIGS. 1 and 2 and in a direction from top to bottom of the plan views of FIGS. 3 and 4, is variable in accordance with the invention depending on whether the side wall 34 is advanced to the position 34*a*, 34*b* or 34 *c*. These positions may be separated, for example, by one-foot intervals, and the width of the compression box may be five feet (where the wall 34 is brought to the position 34*a*), four feet (where the wall 34 is brought to the position 34*b*) or three feet (where the wall 34 is brought to the position 34*c*).

These wall positions and compression box widths are merely illustrative; it is within the scope of the invention to provide any number of selectable wall positions and compression box and shear throat widths between any desired limiting positions of the side wall 34.

The ram head 20 affixed to the indexing ram 18 has a width such that it will slide with a small clearance within compression box 12. As FIG. 4 illustrates by solid and phantom outlines 18*b* and 18*a*, respectively, the position of the ram 18 and hence of the ram head 20 is laterally adjustable. Since the maximum change in the width of the compression box 12 is two feet in the example given above (i.e., the compression box has a width of four feet plus or minus one foot), the maximum required lateral movement of the indexing ram 18 is one foot (i.e., plus or minus six inches from the center position) in order to keep the ram 18 and ram head 20 centered with respect to the compression box 12.

When the indexing ram 18 is advanced, considerable reaction force is generated. This force reacts against a heavily-constructed frame 64 connected to the indexing ram cylinder 32 in such a manner as to permit the cylinder 32 to slide laterally, for example on a track 66. A support 68 supports the opposite end of the cylinder 32 and rests on a plate 70 that moves laterally on tracks 72.

EXAMPLE 1

In a case where it is desired to produce scrap having a maximum dimension of four feet, the side wall 34 is advanced to position 34*b* (FIG. 2), and the lateral position of the ram 18 is adjusted to a central position (18*b* in FIG. 4). A ram head 20 substantially four feet wide (or slightly less to allow clearance) is affixed to the ram 18. The ram head 20 is centered on the ram 18 so that no twisting force is developed on the ram head 18 under the considerable compression force generated as the ram 18 is extended during the indexing part of the cycle.

EXAMPLE 2

When it is desired to produce scrap having a maximum dimension of three feet, the ram head 20 is replaced by a ram head three feet in width (or a little less to allow clearance). The movable wall 34 is advanced an additional foot to the left to the position 34c (FIGS. 2 and 4), and the ram 18 is moved six inches to the left of the position shown in solid outline in FIG. 4. This is the position shown for example in FIG. 3. As the ram 18 is advanced during the indexing part of the cycle, the forces generated on the ram head 20 are substantially uniformly distributed over the face thereof and centered with respect to the ram 18, so that no twisting force is generated.

EXAMPLE 3

When it is desired to produce five-foot scrap, a ram head 20 having a width of five feet (or a little less to provide clearance) is installed on the ram 18. The wall 34 is advanced to the position 34a (FIG. 2), and the lateral position of the ram 18 is adjusted to position 18a (FIG. 4). In this case also, the ram 18 is centered with respect to the ram head, and no twisting forces are generated during the indexing operation.

Thus there is provided in accordance with the invention a novel and highly-effective scrap shear machine wherein the maximum dimension of the scrap processed by the machine can be controllably adjusted in one pass through the machine. Many modifications of the preferred embodiments of the invention will readily occur to those skilled in the art upon a consideration of the preceding disclosure. Accordingly, the invention is not limited to the representative embodiments disclosed herein but extends to all structure that is within the scope of the appended claims, and to equivalents thereof.

I claim:

1. In a scrap shear machine comprising a compression box for compressing scrap into a scrap log, a shear formed with a throat mounted adjacent to the compression box, and an indexing ram and a ram head mounted thereon for incrementally advancing the log into the throat of the shear, whereby increments of the log are sheared off, the improvement comprising means for adjusting the width of the compression box and shear throat and means for adjusting the width of the ram head in accordance with the width of the compression box and shear throat, whereby the maximum dimension of the sheared scrap can be controllably adjusted in one pass through the machine.

2. A scrap shear machine according to claim 1 further comprising means for adjusting the lateral position of the indexing ram in accordance with the adjustment made in the width of the ram head, whereby the ram head remains centered with respect to the indexing ram despite adjustments to the width of the ram head.

3. A scrap shear machine according to claim 2 wherein the means for adjusting the lateral position of the indexing ram comprises piston-cylinder means connected thereto.

4. A scrap shear machine according to claim 1 wherein a side wall of the compression box is movable and the means for adjusting the width of the compression box and shear throat comprises compression means connected to the movable side wall for adjusting the lateral position thereof.

5. A scrap shear machine according to claim 1 wherein the means for adjusting the width of the ram head comprises a set of ram heads of different widths and means for securing a selected one of the set to the ram.

6. A scrap shear machine according to claim 5 wherein the indexing ram heads are of generally rectangular cross section and the securing means comprises bolts passed through apertures formed in the ram head adjacent to the four corners of the rectangular cross section.

7. A scrap shear machine according to claim 1 further comprising precompression piston-cylinder means mounted adjacent to the shear for precompressing the scrap log adjacent to the shear.

* * * * *